US005701890A

United States Patent [19]

Pietrelli

[11] Patent Number: 5,701,890

[45] Date of Patent: Dec. 30, 1997

[54] REGULATOR PROVIDED WITH A MOVABLE DEFLECTOR

[75] Inventor: Nino Pietrelli, Sori, Italy

[73] Assignee: HTM Sport S.p.A., Italy

[21] Appl. No.: 699,499

[22] Filed: Aug. 19, 1996

[30] Foreign Application Priority Data

Aug. 18, 1995 [IT] Italy ..... GE95A0090

[51] Int. Cl.[6] ..... A62B 7/00

[52] U.S. Cl. ..... 128/205.24; 128/204.26; 128/204.27

[58] Field of Search ..... 128/204.26, 204.27, 128/204.28, 201.11, 205.24; 251/120

[56] References Cited

U.S. PATENT DOCUMENTS

| | | | |
|---|---|---|---|
| 3,016,053 | 1/1962 | Medovick | 128/204.28 |
| 3,095,890 | 7/1963 | Cousteau et al. | 137/494 |
| 3,468,307 | 9/1969 | Cummins | 128/204.26 |
| 4,002,166 | 1/1977 | Oliver | 128/204.26 |
| 4,066,076 | 1/1978 | Williamson | 128/204.26 |
| 4,616,645 | 10/1986 | Pedersen et al. | 128/204.26 |

FOREIGN PATENT DOCUMENTS

| | | | |
|---|---|---|---|
| 1384521 | 11/1964 | France | A62B 7/00 |
| WO83/01576 | 5/1983 | WIPO | A62B 7/04 |

*Primary Examiner*—Vincent Millin
*Assistant Examiner*—V. Srivastava
*Attorney, Agent, or Firm*—Larson and Taylor

[57] ABSTRACT

A regulator for an underwater breathing apparatus includes a box-shaped body enclosing the air flow-regulating device, a tube connected to the box-shaped body supporting a mouthpiece, an air inlet duct connected to the box-shaped body through an inlet valve operated by the regulating device, and a deflector element. The deflector is fitted so that it swings inside the regulator between a position in which the deflector partially shuts off the opening of the mouthpiece tube, in the inhalation phase, and another position in which the opening of the mouthpiece tube is at its maximum size, in the exhalation phase.

5 Claims, 4 Drawing Sheets

REGULATOR PROVIDED WITH A MOVABLE DEFLECTOR

FIELD OF THE INVENTION

The present invention relates to regulators for underwater breathing apparatus, and in particular relates to a regulator of the type provided with an inhalation airflow deflector.

BACKGROUND OF THE INVENTION

Such a regulator comprises a box-shaped body enclosing the airflow-regulation device, an air inlet duct connected to the body through a valve operated by the regulating device, a tube supporting a mouthpiece, and a deflector element which is disposed in the regulator in order to direct the inhalation airflow towards the mouthpiece tube, thus assisting the operation of the regulator, and in particular preventing the pressure of the air admitted through the valve from causing difficulties in inhalation. Such a deflector, however, has the disadvantage of obstructing the opening of the mouthpiece tube, consequently making the exhalation phase difficult for the underwater user.

Deflectors are provided in a similar way in a regulator of the type described, for example, in U.S. Pat. No. 4,002,166 (AMF Inc.), in other words regulators provided with bypass tubes which connect the mouthpiece tube to the air inlet duct after the valve.

In such a regulator, the deflector extends in the direction of the length of the mouthpiece tube, and is fixed at one end to the tube, while the other end faces the connection to the bypass tube. The function carried out by the deflector in such a regulator is similar to that of the deflector of the type described above. In this case also, the deflector creates a significant restriction of the working section of the mouthpiece tube in the exhalation phase, and therefore the advantages gained in the inhalation phase, in both cases, are lost or at least reduced.

SUMMARY OF THE INVENTION

The object of the invention is therefore to provide a regulator which, benefiting from the same advantages as known devices of the prior art, is able to overcome the drawbacks.

The subject of the invention is therefore a regulator for an underwater breathing apparatus, comprising: a box-shaped body enclosing the airflow-regulating device, a tube connected to the box-shaped body supporting a mouthpiece, an air inlet duct connected to the box-shaped body through an inlet valve operated by the regulating device, and a deflector element, characterized in that the deflector is fitted so that it swings between a position in which it partially shuts off the opening of the mouthpiece tube, in the inhalation phase, and another position in which the opening of the mouthpiece tube is at its maximum size, in the exhalation phase.

In one embodiment, one end of the deflector is hinged inside the box-shaped body of the regulator near the air inlet valve, while the opposite end is free and swings inside the mouthpiece tube between a position parallel to the longitudinal axis of the tube and a position in which it meets abutment means projecting from the internal surface of the tube near its axis, the deflector being provided with elastic return means.

In a further embodiment, the regulator is provided with a bypass tube which connects the mouthpiece tube to the air inlet duct, after the inlet valve. In this case, the deflector may advantageously be mounted so that it swings, being hinged at one end to the mouthpiece tube near the connection to the bypass tube.

BRIEF DESCRIPTION OF THE DRAWINGS

Further advantages and characteristics will be made clear by the following description of an embodiment of the present invention, provided, by way of example and without restriction, with reference to the attached drawings, in which.

DESCRIPTION OF THE PREFERRED EMBODIMENT OF THE INVENTION

Figure 1:
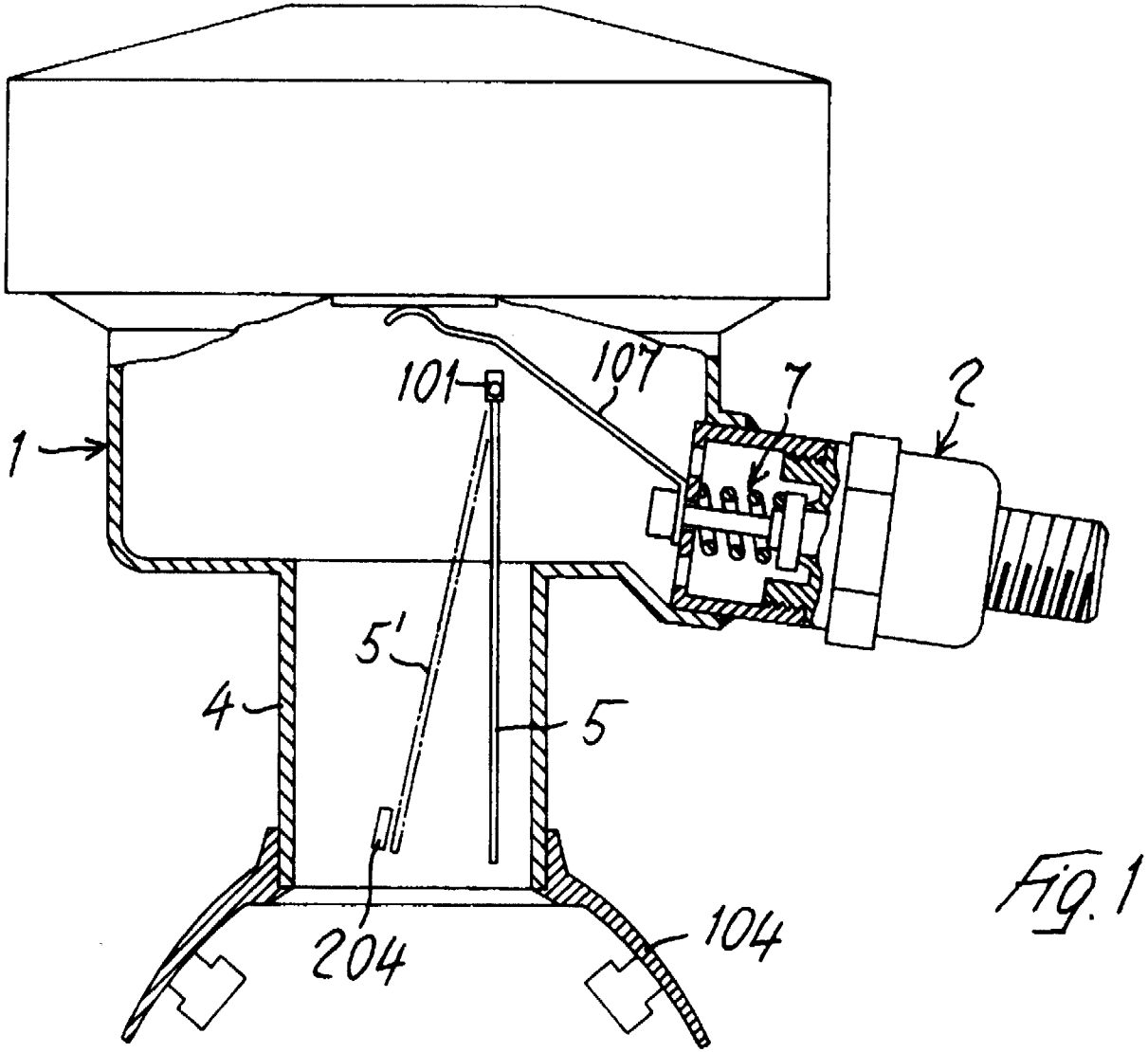
FIG. 1 is a plan view in partial section of a first embodiment of the regulator according to the invention.

FIG. 1 shows a first embodiment of the regulator according to the invention. The number 1 indicates the box-shaped body of the regulator which encloses the airflow inlet-regulating device, of a known type, comprising a flexible diaphragm and a demand lever 107 in engagement with said diaphragm. An inlet duct 2 housing the inlet valve 7 controlled by the aforesaid regulating device by means of the demand lever 107 is connected radially to the box-shaped body 1. A tube 4 formed in one piece with the box-shaped body 1, and supporting at its end a mouthpiece 104 for the inhalation of the air and its exhalation by the user, projects axially from the body 1. Inside the box-shaped body 1, near the inlet valve 7, a deflector 5 is engaged with a pin 101 projecting from the internal surface of the box-shaped body. The free end of the deflector 5 is movable to a position (indicated in broken lines as 5') in which it meets abutment means 204 projecting from the internal surface of the mouthpiece tube 4.

DESCRIPTION OF A SECOND EMBODIMENT OF THE INVENTION

Figure 2:
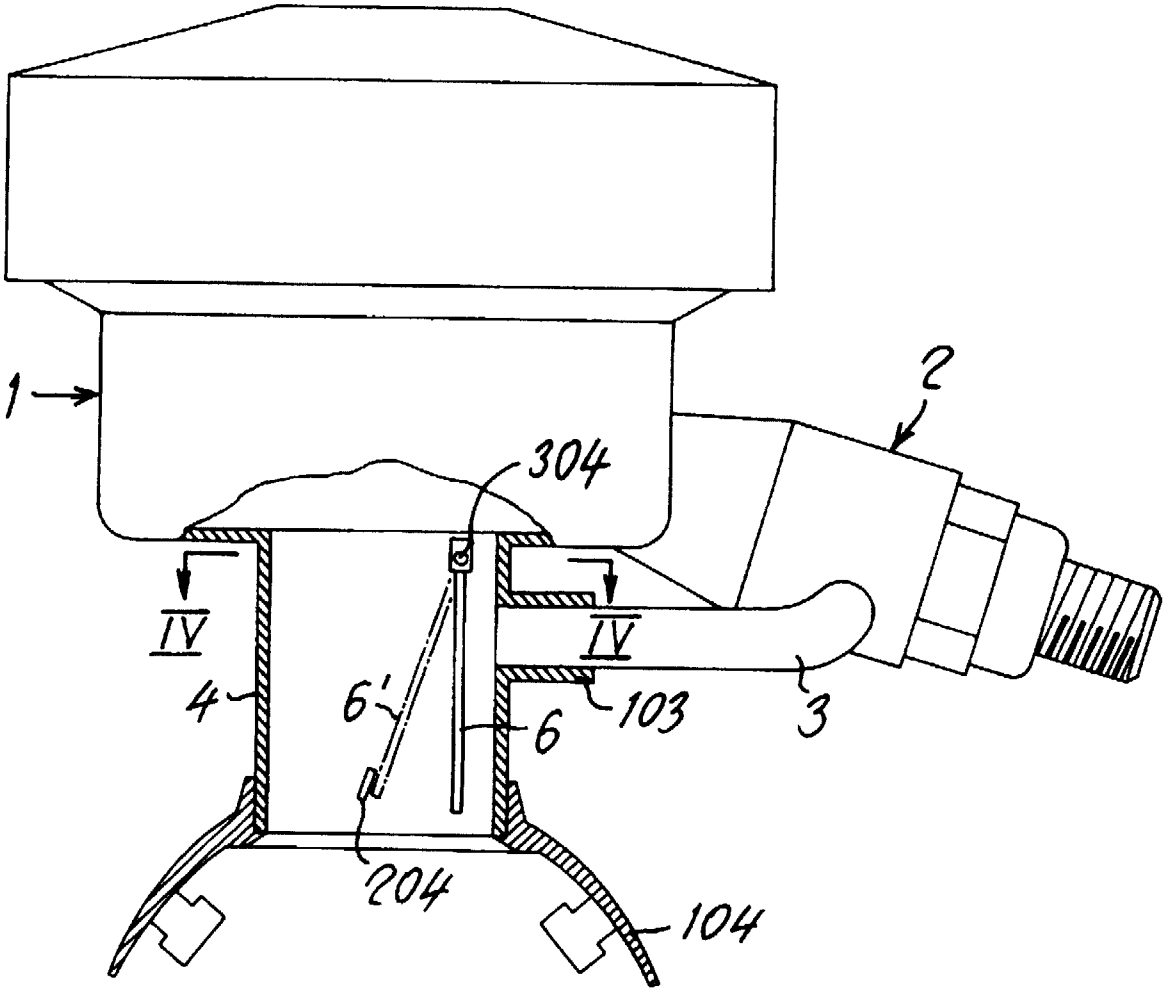
FIG. 2 is a plan view in partial section of a second embodiment of the regulator according to the invention.

FIG. 2 shows a second embodiment of the regulator according to the invention; numbers identical to those shown in FIG. 1 correspond to identical parts. In the embodiment shown in FIG. 2, a connection is made between the inlet duct 2 and the tube 4 of the mouthpiece 104 by the bypass tube 3 which is connected to the tube 4 through the connecting duct 103. A deflector 6 is fitted inside the mouthpiece tube 4, near the wall in which the connecting duct 103 with the bypass tube 3 opens. The end of the deflector 6 facing the box-shaped body 1 of the regulator is hinged on a pin 304 integral with the tube 4. The other end of the deflector 6 is free to move inside the tube 4 from a position in which the deflector is parallel to the longitudinal axis of the tube 4, as illustrated in solid lines in the figure, to a position 6' (broken line) in which the deflector meets abutment means, in particular an abutment strip 204 projecting radially from the internal surface of the tube 4, in a similar way to the illustration in FIG. 1.

Figure 3:
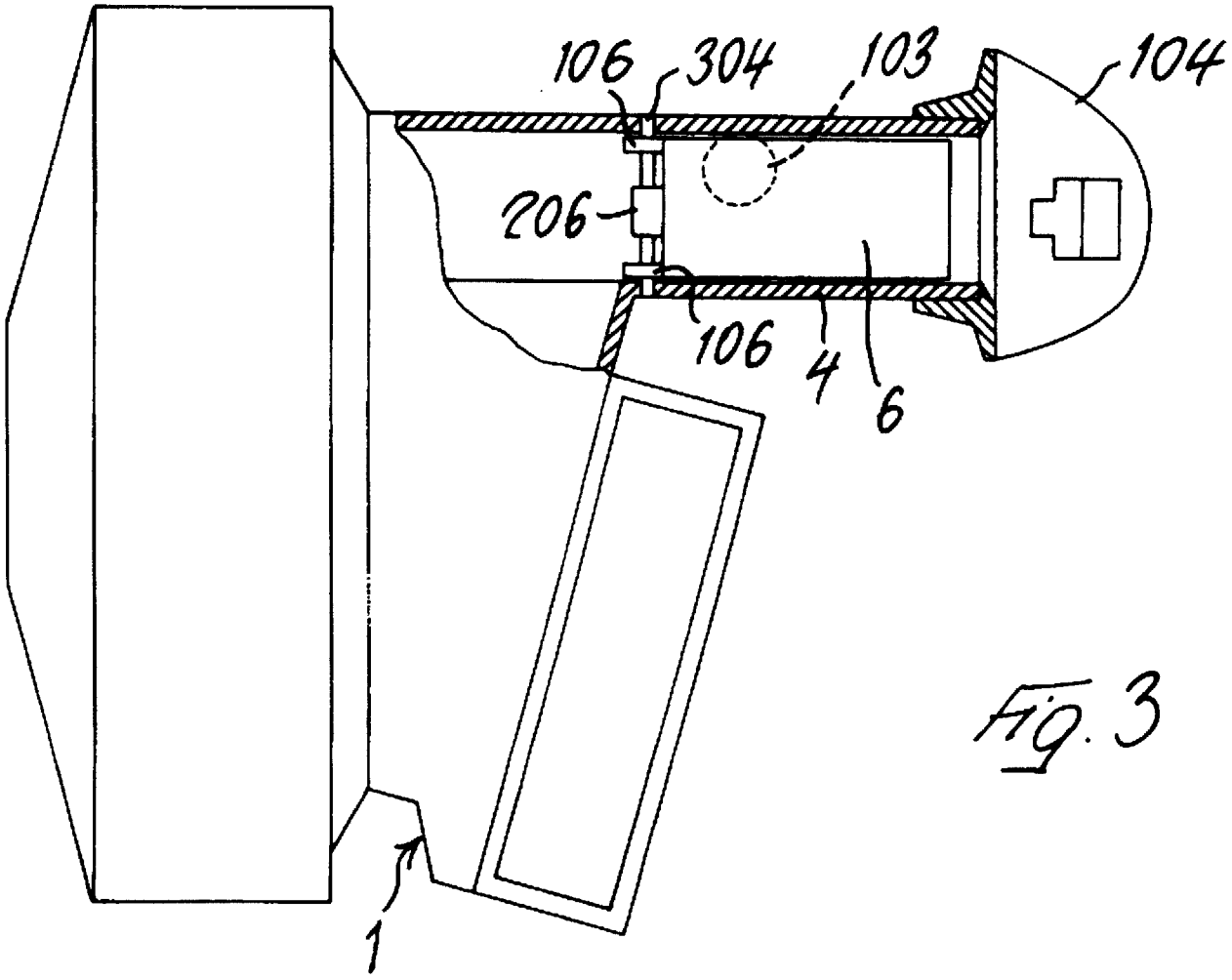
FIG. 3 is a side elevation in partial section of the regulator shown in FIG. 2.

FIG. 3 is a side elevation of the regulator shown in FIG. 2, with the tube 4 of the mouthpiece 104 in longitudinal section. The figure shows the connection between one end of the deflector 6 and the tube 4, made by inserting the through pin 304 into the tail 206 and into the lugs 106 projecting from the end of the deflector 6. These lugs 106, whose purpose will be described subsequently, are located near the upper and lower edges of the end of the deflector 6. It may also be noted that the connecting duct 103 for the bypass tube 3 opens into the tube 4 in a tangential position.

Figure 4:
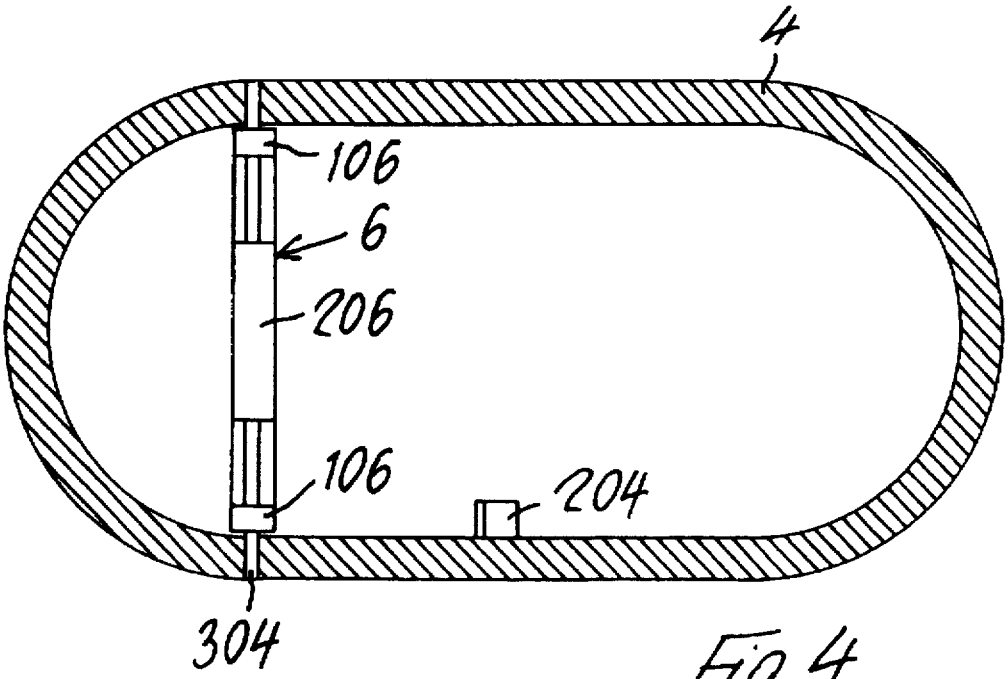
FIGS. 4 and 5 are two longitudinal sectional views along the line IV—IV in FIG. 2.
Figure 5:
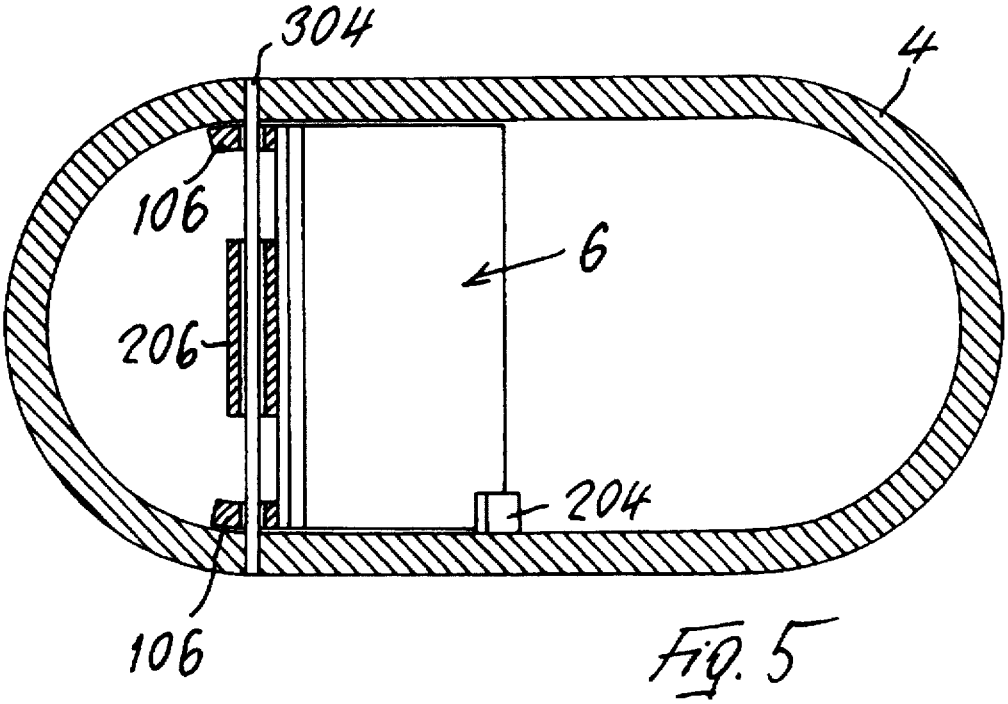

Finally, FIGS. 4 and 5 show two sectional views of the tube along the line IV—IV in FIG. 2, FIG. 4 being a view of the deflector 6 in a position parallel to the longitudinal axis of the tube 4, while FIG. 5 shows the deflector when (see FIG. 2, 6') it meets the abutment strip 204 which projects radially from the internal surface of the tube 4. Both figures show the connection between the pin 304 and the tall 206 and the lugs 106 which project from the end of the deflector 6.

The operation of the regulator according to the invention will be evident from the following. As is known in the present state of the art, when the diver inhales from the mouthpiece 104, the regulating device, through the rod 107, causes the valve 7 to open and therefore allows the admission of air from the duct 2. It is convenient to place a deflector near the opening of the valve 7, in such a way as to assist the direction of the flow of air towards the tube 4 of the mouthpiece, in such a way as to prevent the pressure of the air admitted into the regulator from making it difficult to open the inlet valve 7.

The deflector 5 according to the invention enables the flow to be diverted towards the mouthpiece tube 4; furthermore, owing to its ability to swinge between the two positions shown in FIG. 1, this deflector does not form an obstacle in the exhalation phase to the flow of air from the mouthpiece tube 4. In fact, whereas in the inhalation phase the deflector assumes the position 5', in the subsequent exhalation phase the position parallel to the axis of the tube 4, shown in solid lines in FIG. 1, makes the maximum section of the mouthpiece tube 4 available to the flow of exhaled air. Advantageously, to ensure the return of the deflector 5 to the position parallel to the longitudinal axis of the tube 4, this deflector will be provided with elastic return means.

The operation of the embodiment shown in FIG. 2, in which a movable deflector has been fitted to a regulator provided with a bypass tube, is entirely similar. In such a regulator, for example the one described in the cited patent held by AMF Inc., the bypass tube 3 permits a better supply of air, since the air flows directly from the inlet duct 2 into the mouthpiece tube 4, making it unnecessary to oppose the lowering of the membrane of the regulating device which controls the inlet valve. To improve this effect, the deflector 6 is inserted into the tube 4. This deflector 6 provides maximum control of the flow of air from the bypass tube 3 through the connecting duct 103 on the wall of the tube 4. To maximize this control, the pin 304 on which the deflector 6 is hinged is disposed in a position very close to the wall in which the duct 103 opens.

In this way, in the inhalation phase, the free end of the deflector moves to the position indicated by 6' in FIG. 2, permitting the inflow of air to the mouthpiece 104, while avoiding any negative effect on the regulating device. The position of the abutment strip 204 is also subject to careful adjustment in accordance with the desired effects.

In the subsequent exhalation phase, however, it is particularly important for the deflector to be repositioned in the way shown in solid lines and indicated by the number 6 in FIG. 2, so that it offers to the user the largest possible working section of the mouthpiece tube 4. For this purpose, the deflector 6 is provided with elastic return means. In particular, in the illustrated embodiment, the end of the deflector 6 hinged on the pin 304 has lugs 106 on the upper and lower edges of the deflector (see FIGS. 4 and 5).

When, in the inhalation phase, the free end of the deflector 6 is in contact with the abutment strip 204, the lugs 106, made of elastomeric material, are deformed by the internal surface of the tube 4, which has a curved section (see FIG. 5). The result of this deformation is that, once the exhalation phase has commenced, and therefore the force provided by the flow of air leaving the bypass tube 3 has ceased, the lugs return the deflector 6 to the position shown in FIG. 4 in solid lines, parallel to the longitudinal axis of the tube 4, thus making available the greater part of the section of the tube.

Naturally, in the regulator according to the invention the deflector may be made to be hinged inside the box-shaped body 1 even when the bypass tube 3 is present. However, if the deflector is positioned directly within the mouthpiece tube 4, the control of the inhalation airflow becomes optimal.

The regulator provided with a deflector designed in this way overcomes the disadvantages which may be present with the use of such an arrangement, eliminating the negative effects shown in the exhalation phase by the known devices, regardless of whether the regulators are provided with bypasses for the admission of the air.

I claim:

1. A regulator for a second stage underwater breathing apparatus comprising:

a box-like shaped regulator control chamber;

a flexible diaphragm at one end of said chamber;

a mouthpiece tube at another end of said chamber;

a mouthpiece connected to said mouthpiece tube;

an air supply connected to a side of said chamber, said air supply including an air valve, and a demand lever in said chamber connected to said valve and in engagement with said diaphragm to open and close said valve, and an adjustable air deflector hinged by one end to said chamber at a position near said air valve and extending by a free end into said mouthpiece tube, the air deflector being mounted to swing from a first position in which it partially closes the opening of said mouthpiece tube to increase cross section of the air flow passage from the air supply to the mouthpiece during the inhalation phase, and a second position in which the opening of the mouthpiece tube is at a maximum size to increase cross section of the air flow passage from the mouthpiece to a discharge valve in the exhalation phase.

2. The regulator according to claim 1 wherein said air deflector is disposed in said second position so as to be substantially parallel to the longitudinal axis of said mouthpiece tube, said air deflector being movable between said second position to the first position wherein said air deflector abuts against abutment means projecting from the internal surface of said tube at a position near its axis, said deflector including elastic return means.

3. The regulator according to claim 1 wherein said air valve includes a bypass tube connecting the mouthpiece tube to the air inlet duct at a position after the inlet valve.

4. The regulator according to claim 3 wherein said deflector is hinged at one end to said mouthpiece tube near the connection of said bypass tube, the opposite end being free and swinging between the second position in which the deflector is substantially parallel to the longitudinal axis of the mouthpiece tube and the first position in which the deflector abuts against abutment means projecting from the internal surface of the mouthpiece tube near the longitudinal axis, said deflector including elastic return means.

5. The regulator according to claim 1, further comprising elastic return means for the deflector comprising lugs of elastomeric material disposed at the hinged end of the deflector on its upper and lower edges and interacting with a curved portion of an internal surface of the mouthpiece tube in such a way that said curved surface causes the deformation of the lugs when the free end of the deflector contacts an abutment means.

* * * * *